United States Patent [19]

Watanabe et al.

[11] Patent Number: 4,471,334

[45] Date of Patent: Sep. 11, 1984

[54] ON-LOAD TAP-CHANGING TRANSFORMER

[75] Inventors: Masaru Watanabe; Minoru Hoshi; Shigeo Kikuchi, all of Hitachi, Japan

[73] Assignee: Hitachi, Ltd., Tokyo, Japan

[21] Appl. No.: 401,746

[22] Filed: Jul. 26, 1982

[30] Foreign Application Priority Data

Jul. 29, 1981 [JP] Japan ..... 56-117740

[51] Int. Cl.[3] ..... H01F 21/12

[52] U.S. Cl. ..... 336/150; 336/145; 336/146; 336/147; 323/340

[58] Field of Search ..... 336/145, 146, 147, 150; 323/340, 345

[56] References Cited

U.S. PATENT DOCUMENTS 3,560,843 2/1971 Nakagawa et al. ..... 336/150 X

FOREIGN PATENT DOCUMENTS 4413883 2/1966 Japan .

44967 8/1966 Japan ..... 336/150

4726252 7/1968 Japan ..... 336/150

56-94612 7/1981 Japan ..... 336/147

*Primary Examiner*—G. P. Tolin

*Assistant Examiner*—S. Steward

*Attorney, Agent, or Firm*—Antonelli, Terry & Wands

[57] ABSTRACT

An on-load tap-changing transformer in which its high-voltage winding is axially divided into parallel-connected halves, and an end conductor constituting part of the high-voltage winding is connected to the other terminal of each of the halves. A coarse tap coil connected by the end conductor to the other terminal of each of the halves of the high-voltage winding is disposed adjacent to the associated half, and a fine tap coil connected to the coarse tap coil through a coarse tap selector used for the change-over of the tap position to the taps of the coarse tap coil is disposed at a radial position spaced apart from the coarse tap coil. The end conductor is wound together with the conductors of the fine tap coil.

4 Claims, 11 Drawing Figures

ON-LOAD TAP-CHANGING TRANSFORMER

BACKGROUND OF THE INVENTION

1. Field of the Invention

This invention relates to an on-load tap-changing transformer, and more particularly to that of the coarse tap selector type provided with a coarse tap coil and a fine tap coil.

2. Description of the Prior Art

An on-load tap-changing transformer having a structure as shown in FIG. 1 is known as one form of such a transformer. Referring to FIG. 1, a high-voltage winding 1 has a high-voltage line terminal 6 terminating in the middle thereof and is divided into halves in its axial direction (in the direction of its height) at the connected position of this terminal 6. The halved portions of the high-voltage winding 1 are connected in parallel with each other. A coarse tap coil 2 and a fine tap coil 3 having approximately equal inductance values are connected to each of the upper and lower ends of the high-voltage winding 1, and a low-voltage winding 4 is disposed inside the high-voltage winding 1. The reference numeral 5 designates the iron core of the transformer.

In the present application, the terms "minimum-voltage tap selection mode", "rated voltage tap selection mode" and "maximum voltage tap selection mode" are used hereinafter to designate the case in which the tap coils 2 and 3 are disconnected from the circuit, and primary current flows through the high-voltage winding 1 only; the case in which the fine tap coils 3 are disconnected from the circuit, and primary current flows through the coarse tap coils 2 and high-voltage winding 1; and the case in which primary current flows through all of the coarse tap coils 2, fine tap coils 3 and high-voltage winding 1, respectively.

In the transformer structure shown in FIG. 1, primary current flows through the high-voltage winding 1 only in the minimum voltage tap selection mode in which the coarse and fine tap coils 2 and 3 are disconnected from the circuit to render the turns of the primary winding to the minimum. In such a mode, no magnetomotive force is produced in the tap coils 2 and 3 in the axial direction of the high-voltage winding 1, and there occurs an increase in the magnetic flux leaking from the upper and lower end portions of the high-voltage winding 1 in the radial direction of the high-voltage winding 1. That is, the quantity of leakage flux increases, resulting in an increased stray loss. Especially, when the transformer has a large capacity, the electromagnetic action between the radially leaking magnetic flux and the short-circuit current appearing in a shorted condition generates a large mechanical force in the axial direction of the primary winding, tending to impair the primary winding. For the above reason, the transformer structure shown in FIG. 1 is not applicable to a transformer of large capacity.

An on-load tap-changing transformer having a structure as shown in FIG. 2 is proposed to obviate the defect pointed out above. In the transformer structure shown in FIG. 2, the coarse tap coils 2 and fine tap coils 3 are disposed at a position radially spaced apart from the high-voltage winding 1, and the high-voltage winding 1 has a height (the axial level) equal to that of the low-voltage winding 4. Therefore, even in the minimum voltage tap selection mode in which all of the coarse tap coils 2 and fine tap coils 3 are disconnected from the circuit, no unbalance occurs between the axial magnetomotive forces of the high-voltage and low-voltage windings 1 and 4. The defect described with reference to FIG. 1 can thus be obviated, and the transformer structure shown in FIG. 2 is applicable to a transformer of large capacity. However, due to the fact that the coarse tap coils 2 and fine tap coils 3 are spaced apart from the high-voltage winding 1 in the radial direction, the transformer structure shown in FIG. 2 is defective in that the increase in the radial dimensions of the primary winding lowers the space factor of the primary winding.

An improved on-load tap-changing transformer as shown in FIG. 3 is proposed to obviate the defect of the transformer shown in FIG. 2. In FIG. 3, the coarse tap coils 2 are disposed at the upper and lower ends respectively of the high-voltage winding 1, and the fine tap coils 3 only are disposed at a radial position spaced apart from the high-voltage winding 1. According to the transformer structure shown in FIG. 3, the unbalance between the axial magnetomotive forces of the high-voltage and low-voltage windings 1 and 4 in the minimum voltage tap selection mode is relatively small. Therefore, the illustrated transformer structure is satisfactorily applicable to a transformer of large capacity. Also, because of the fact that the fine tap coils 3 only are disposed at the radial position spaced apart from the high-voltage winding 1, the radial dimensions of the primary winding do not appreciably increase, and the space factor of the primary winding is not also appreciably lowered.

However, in the transformer structure shown in FIG. 3, the electrostatic coupling between the end of the coarse tap coils 2 and that of the fine tap coils 3 is not strong. Therefore, in the event of intrusion of a lightning impulse voltage from the high-voltage line terminal 6, a high voltage appears across the tap coils 2 and 3, and the withstand voltage characteristic of the electrodes in the diverter switch of the on-load tap changer becomes especially a serious problem.

This problem will be described in further detail with reference to FIG. 4 which is a tap connection diagram of the transformer shown in FIG. 3. Referring to FIG. 4, the on-load tap changer generally designated by the reference numeral 7 includes a coarse tap selector 8, tap selectors 9A, 9B and a diverter switch 10. The diverter switch 10 includes a pair of electrodes 11A and 11B. In FIG. 4, the coarse tap coil 2 is connected to the other terminal or the neutral point of the high voltage winding 1, and the fine tap coil 3 is connected through the coarse tap selector 8 to the coarse tap coil 2. Eight taps $T_1, T_2, \ldots, T_8$ of these tap coils 2 and 3 are alternately changed over by the tap selectors 9A and 9B. More precisely, the odd-numbered taps $T_1$, $T_3$, $T_5$ and $T_7$ are sequentially selected by the tap selector 9A, and the even-numbered taps $T_2$, $T_4$, $T_6$ and $T_8$ are sequentially selected by the tap selector 9B. Thus, when one of the tap selectors selecting one of the associated taps comes to the position of the last tap in the array, the other tap selector returns to the position of the first tap in the array as shown in FIG. 4. Such a selection sequence is repeated thereafter.

In the on-load tap-changing transformer having such a structure, the voltage appearing across the electrodes 11A and 11B of the diverter switch 10 is normally equal to the voltage across the adjacent taps. Since the fine tap coil 3 is disposed at the radial position spaced apart from the coarse tap coil 2, the electrostatic coupling therebetween is not strong. Therefore, in the event of application of a lightning impulse voltage including high-frequency components to the high-voltage line terminal 6, high-frequency voltages whose absolute values are approximately equal to each other are induced in the coarse tap coil 2 and fine tap coil 3 respectively. In this case, the phase of the voltage induced in the fine tap coil 3 is delayed relative to that induced in the coarse tap coil 2, since the fine tap coil 3 is remote from the high-voltage winding 1 relative to, the coarse tap coil 2. Especially, when the tap selectors 9A and 9B are connected to the taps $T_1$ and $T_8$ respectively as shown in FIG. 4, a large voltage differential attributable to the phase difference is applied across the electrodes 11A and 11B of the diverter switch 10 although the absolute values of the voltages induced in the tap coils 2 and 3 may be the same. This voltage differential is so large that it is substantially equal to the voltage induced across the most spaced taps. Therefore, the tap arrangement in such a transformer is limited by the withstand voltage characteristic of the electrodes 11A and 11B of the diverter switch 10 employed in the transformer, and, because of such a limitation, the transformer structure shown in FIG. 3 is not applicable to a transformer of, for example, insulation grade No. 170 or higher in which the insulation grade of the high-voltage line terminal is very high.

FIG. 5 shows schematically in section the arrangement of the conductors in the fine tap coil 3. Generally, the number of required conductors constituting the fine tap coil 3 is odd when the fine tap, coil 3 is combined with the on-load tap changer 7 including the coarse tap selector 8 therein. Thus, when, for example, seven conductors a, b, c, d, e, f and g are wound in a relation superposed in double layer form in the axial direction of the high-voltage winding 1 as shown in FIG. 5, an electrical insulator 12 is used to shape up the external configuration of the fine tap coil 3. In this manner, the seven conductors a, b, c, d, e, f, g and the insulator 12 are superposed in double layer form in the direction of height to be wound together into a cylindrical-helical form as shown by a block 13 in FIG. 5. Another block 14 indicates a repetition of the block 13, and, therefore, it is not shown in detail. Such a prior art conductor arrangement is defective among others in that the conductor winding operation is troublesome since an especially prepared insulator 12 must be used for the production of the fine tap coil 3.

FIG. 6 shows the distribution of the magnetomotive force generated at various principal tap positions in the on-load tap-changing transformer having the structure shown in FIGS. 3 and 4. The thick solid curve LV in FIG. 6 represents the distribution of the magnetomotive force induced in the low-voltage winding 4. The magnetomotive force in the middle portion of the distribution curve LV is smaller than that in the remaining portions because the middle portion of the low-voltage winding 4 is coarsely wound. In the minimum voltage tap selection mode, the distribution of the magnetomotive force of the primary winding is represented by the one-dot chain curve $HV_L$. Since, in this mode, primary current does not flow through the tap coils 2 and 3 and flows only through the high-voltage winding 1, the magnetomotive force is zero in the upper and lower end portions of the primary winding as seen in FIG. 6. In the case of the curve $HV_L$ too, the magnetomotive force is similarly small in the middle portion of the distribution curve $HV_L$ because the middle portion of the high-voltage winding 1 is also coarsely wound. The dotted curve $HV_R$ represents the distribution of the magnetomotive force in the rated voltage tap selection mode in which primary current flows through the coarse tap coils 2 too but not through the fine tap coils 3. Since, in this mode, the total primary current decreases due to the insertion of the coarse tap coils 2 in the circuit, the magnetomotive force of the high-voltage winding 1 is smaller than that in the minimum-voltage tap selection mode, and the magnetomotive force generated by the coarse tap coils 2 appears in the upper and lower end portions of the primary winding as seen in FIG. 6. The thin solid curve $HV_H$ represents the distribution of the magnetomotive force in the maximum-voltage tap selection mode in which primary current flows also through the fine tap coils 3. Although, in this mode, the magnetomotive force of the high-voltage winding 1 is smaller than that in the rated voltage tap selection mode, the magnetomotive force appearing in the upper and lower end portions of the primary winding is larger than that in the rated voltage tap selection mode because the magnetomotive force of the fine tap coils 3 is added to that of the coarse tap coils 2 in such end portions. It can be understood from FIG. 6 that the prior art on-load tap-changing transformer having the structure shown in FIGS. 3 and 4 is defective among others in that the magnetomotive force is zero in the end portions of the primary winding in the minimum voltage tap selection mode.

SUMMARY OF THE INVENTION

It is therefore a primary object of the present invention to provide an improved on-load tap-changing transformer in which the leakage flux leaking radially from the upper and lower end portions of the high-voltage winding is minimized to alleviate the mechanical force generated in a short-circuited condition, in which the withstand voltage of the electrodes of the diverter switch need not be modified to deal with application of a lightning impulse voltage to the high-voltage line termnal, and in which the distribution of the magnetomotive force in the axial direction of the primary winding can be improved over the prior art.

A preferred embodiment of the on-load tap-changing transformer according to the present invention is feature by the fact that its high-voltage winding is axially divided into parallel-connected halves, and an end conductor constituting part of the high-voltage winding is connected to the other terminal of each of the halves, a coarse tap coil connected by the end conductor to the other terminal of each of the halves of the high-voltage winding being disposed adjacent to the associated halve, a fine tap coil connected to the coarse tap coil through a coarse tap selector being disposed at a radial position spaced apart from the coarse tap coil, the end conductor being wound together with the conductors of the fine tap coil.

The above and other objects, features and advantages of the present invention will be apparent from the following detailed description taken in conjunction with the accompanying drawings.

DESCRIPTION OF THE PREFERRED EMBODIMENTS

Figure 7:
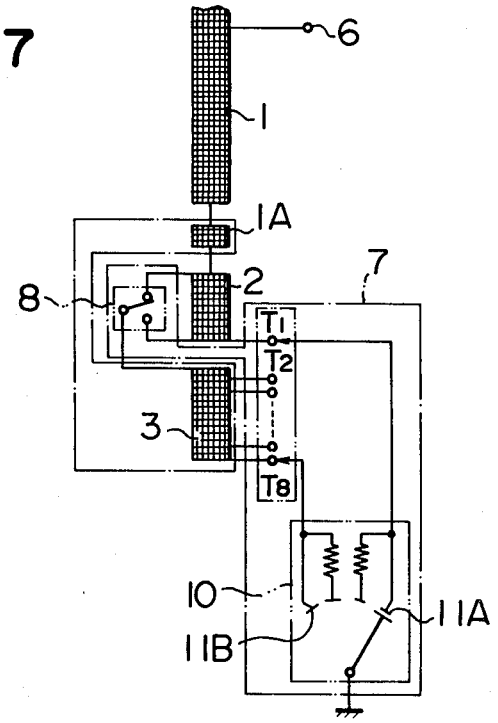
FIG. 7 is a tap connection diagram in a preferred embodiment of the on-load tap-changing transformer according to the present invention.

A preferred embodiment of the on-load tap-changing transformer according to the present invention will now be described in detail with reference to FIGS. 7 to 10. In FIGS. 7 and 10, the same reference numerals are used to designate the same or equivalent parts of the prior art ones.

Figure 1:
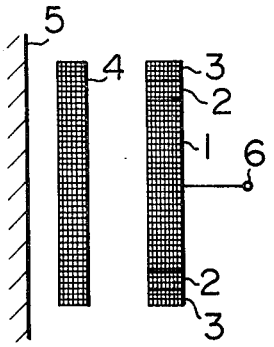
FIG. 1 PRIOR ART
FIGS. 1, 2 and 3 are diagrammatic views showing various winding arrangements in prior art on-load tap-changing transformers.
Figure 2:
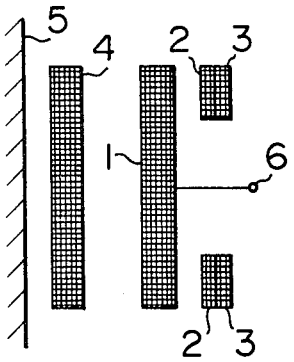
FIG. 2 PRIOR ART
Figure 3:
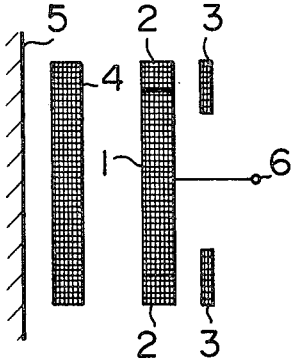
FIG. 3 PRIOR ART
Figure 4:
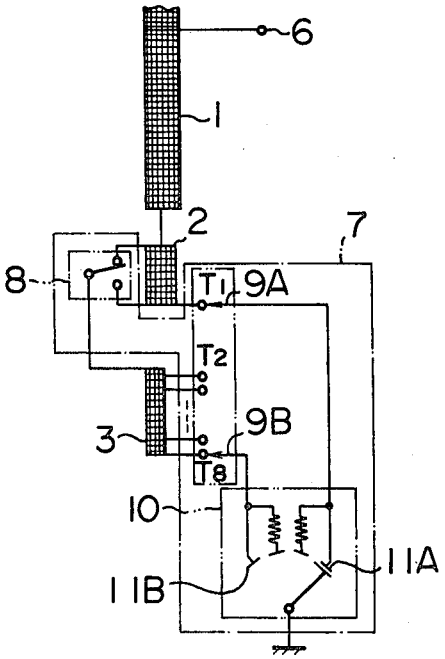
FIG. 4 PRIOR ART
FIG. 4 is a tap connection diagram in the on-load tap-changing transformer shown in FIG. 3.
Figure 5:
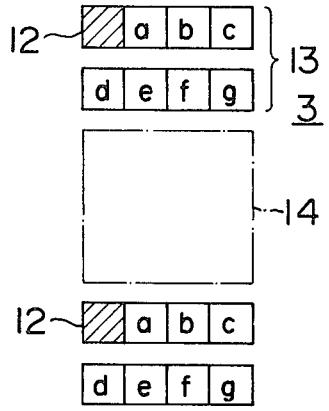
FIG. 5 PRIOR ART
FIG. 5 is a schematic view showing the sectional structure of the fine tap coil in the transformer shown in FIG. 3.
Figure 6:
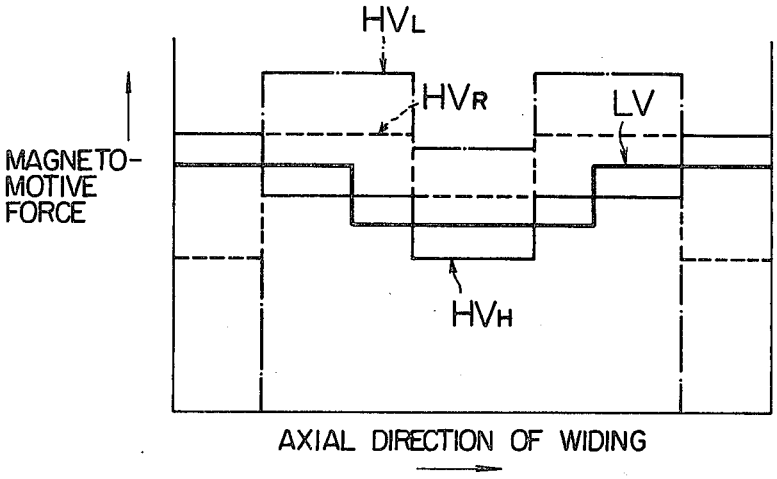
FIG. 6 PRIOR ART
FIG. 6 shows the distribution of the magnetomotive force generated at principal tap positions in the prior art on-load tap-changing transformer shown in FIGS. 3 and 4.

In FIG. 7 showing the structure of the on-load tap-changing transformer embodying the present invention, the high-voltage winding 1, one of the coarse tap coils 2 and one of the fine tap coils 3 are disposed, together with the low-voltage winding (not shown), relative to the iron core (not shown) in an arrangement similar to that shown in FIGS. 3 and 4. An end conductor 1A constituting part of the high-voltage winding 1 is connected to the other terminal of each of the parallel-connected halves of the high-voltage winding 1 halved in the axial direction thereof at the terminating position of the high-voltage line terminal 6. This end conductor 1A is wound together with the conductors of the fine tap coil 3 disposed at the position spaced apart from the coarse tap coil 2 in the radial direction of the high-voltage winding 1. More precisely, the end conductor 1A constituting part of the high-voltage winding 1 is led out toward the fine tap coil 3 to be disposed adjacent to the conductor a of the fine tap coil 3, as shown in FIG. 8, and the conductors 1A, a, b, c, and d, e, f, g arranged in double layer relation in the axial direction of the high-voltage winding 1 are wound together into a cylindrical-helical form as shown in FIG. 9.

Figure 8:
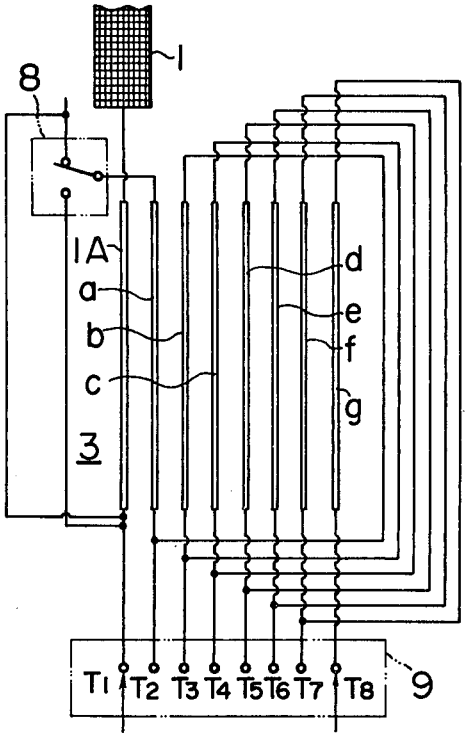
FIG. 8 is a connection diagram showing how the conductors are connected in the fine tap coil in the transformer shown in FIG. 7.

In such a conductor arrangement, the end conductor 1A and the conductors of the fine tap coil 3 are connected in a circuit as shown in FIG. 8. Referring to FIG. 8, the end conductor 1A, which is connected in series with the high-voltage winding 1, is connected to one of the terminals of the coarse tap coil 2 and to one of the terminals of the coarse tap selector 8. The seven conductors a, b, c, d, e, f and g constituting the fine tap coil 3 are successively connected in such a relation that the end point of the turns of one of the conductors is connected to the start point of the turns of the next conductor, thereby forming a series connection. Taps $T_2$, $T_3$, $T_4$, $T_5$, $T_6$ and $T_7$ are led out from the individual connection points respectively of these conductors. The other end of the conductor a is connected to the coarse tap selector 8, and the other end of the conductor g terminates in a tap $T_8$.

In such a circuit, the end conductor 1A constituting part of the high-voltage winding 1 is disposed adjacent to the conductor a of the fine tap coil 3, so that they are electrostatially intimately coupled to each other. Therefore, in the event of application of a lightning impulse voltage to the high-voltage line terminal 6, the phase of a high-frequency voltage induced by the lightning impulse in the fine tap coil 3 spaced apart from the high-voltage winding 1 is forcedly advanced to approach the phase of the voltage induced in the coarse tap coil 2. Consequently, the voltage appearing across the electrodes 11A and 11B of the diverter switch 10 due to the voltage differential attributable to the application of the lightning impulse can be greatly reduced to such a level that it is lower than the withstand voltage level of the electrodes 11A and 11B of the diverter switch 10 even when the transformer has a high insulation grade in respect of the high-voltage line terminal 6 terminating in the transformer.

Figure 9:
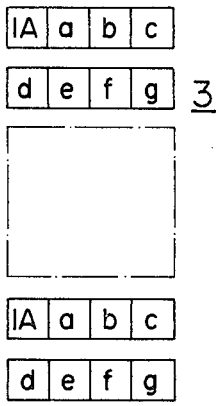
FIG. 9 is a schematic view showing the sectional structure of the fine tap coil in the transformer shown in FIG . 7.
Figure 10:
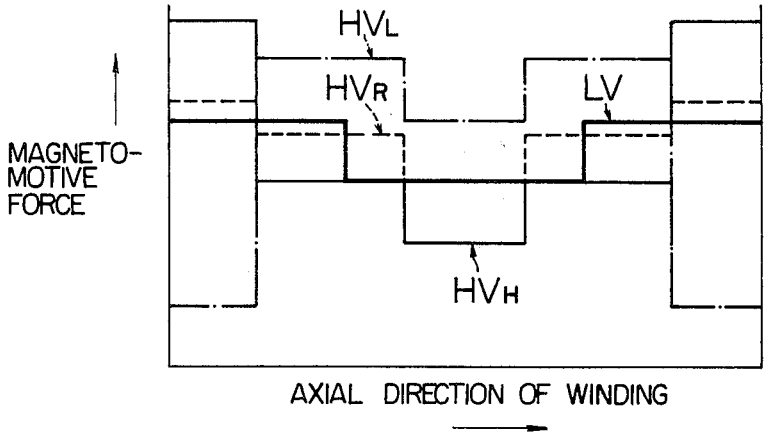
FIG. 10 shows the distribution of the magnetomotive force generated at the principal tap positions in the transformer according to the present invention.

In the fine tap coil 3 shown in FIG. 8, the end conductor 1A of the high-voltage winding 1 occupies the position having been occupied by the insulator in the prior art structure, as shown in FIG. 9, and, therefore, the space factor of the tap coils can be improved. Further, the degree of freedom for the design of the conductor arrangement can be increased according to the present invention, since one conductor, that is, the end conductor 1A of the high-voltage winding 1 is added to the odd number of conductors a, b, . . . , g of the fine tap coil 3 to provide an even number of conductors in total. Thus, although the eight conductors shown in FIG. 9 are arranged in such a pattern that the layers each including four conductors aligned in the radial direction are superposed in double layer relation in the axial direction of the high-voltage winding 1, the arrangement may, for example, be such that the layers each including two conductors aligned in the radial direction are superposed in quadruple layer relation in the axial direction.

In an experiment conducted by the inventors, the end conductors 1A were selected to occupy about 10% of the number of turns of the high-voltage winding 1, and such conductors were wound together with the conductors of the fine tap coils 3 to provide a transformer having a winding arrangement similar to that shown in FIG. 3. FIG. 10 shows the distribution of the magnetomotive force in such a transformer. In FIG. 10, the thick solid curve LV represents the distribution of the magnetomotive force of the low-voltage winding, and the dotted curve $HV_R$, thin solid curve $HV_H$ and one-dot chain curve $HV_L$ represent the magnetomotive force of the primary winding in the rated voltage tap selection mode, maximum voltage tap selection mode and minimum voltage tap selection mode respectively. It will be seen in FIG. 10 that, even in the minimum voltage tap selection mode, the magnetmotive force is generated in the upper and lower end portions of the primary winding due to the presence of the end conductors 1A of the high-voltage winding 1 in, these end portions. Therefore, the relative distribution of the magnetomotive forces of the high-voltage and low-voltage windings can be improved, and a transformer having a large capacity can be obtained in which the stray loss is less than hitherto, and the mechanical force acting upon the primary winding in a shorted state is also greatly smaller than hitherto.

When the center tap $T_1$ is selected, primary current flows through the high-voltage winding 1 and the coarse tap coil 2 only, and no current flows through the fine tap coil 3. On the other hand, in the case of a tap position at which the number of turns is smaller than when the center tap position is selected, primary current flows through the high-voltage winding 1 and the fine tap coil 3 only. This leads to the problem that the leakage impedance varies greatly between these two tap positions. However, because of the fact that the end conductor 1A constituting part of the high-voltage winding 1 is wound together with the conductors of each of the fine tap coils 3 in the transformer according to the present invention, the magnetomotive force distribution can be improved over the prior art as described above, and, consequently, the rate of leakage impedance variation between the two tap positions can also be reduced.

Figure 11:
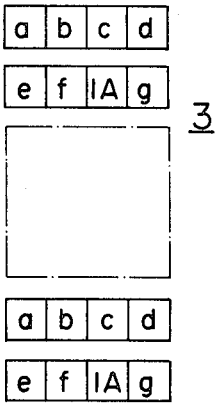
FIG. 11 is a schematic view showing a modification of FIG. 9.

In the aforementioned embodiment of the present invention, the end conductor 1A constituting part of the high-voltage winding 1 is disposed adjacent to the conductor a of the fine tap coil 3 terminating in the tap $T_2$. It is apparent, however, that this end conductor 1A can be disposed in any desired position. For example, the end conductor 1A may be disposed in a position as shown in FIG. 11. Referring to FIG. 11, the end conductor 1A is disposed adjacent to the conductor g terminating in the tap $T_8$ providing the maximum voltage difference between these two conductors. In this case, the electrostatic coupling between these two conductors can enhance the effect of decreasing the phase difference between the voltages induced in the two tap coils. In the aforementioned embodiment, the end conductor 1A is wound together with the conductors of the fine tap coil 3 in such a relation that is disposed adjacent to one of the conductors terminating in one of the taps. However, the number of turns of the end conductor 1A may be such that the end conductor 1A is juxtaposed with a plurality of conductors terminating in a plurality of taps.

It will be understood from the foregoing detailed description that the on-load tap-changing transformer constructed according to the present invention is advantageous over the prior art ones in that the voltage level induced across the electrodes of the diverter switch in the event of application of a lightning impulse voltage can be greatly reduced. By virtue of the fact that a high withstand voltage characteristic need not be provided between the electrodes of the diverter switch, the present invention can be easily applied to a transformer having a high-voltage line terminal of high insulation grade. Also, the incorporation of part of the high-voltage winding in the fine tap coil improves the magnetomotive force distribution, and a transformer of large capacity can be manufactured which is free from the prior art troubles.

What is claimed is:

1. An on-load tap-changing transformer comprising:

a low-voltage winding;

a high-voltage winding disposed concentrically outside of said low-voltage winding and axially divided into two winding portions at an intermediate point thereof which is connected to a high-voltage line terminal, said high-voltage winding including end conductor means connected to end terminals of said two winding portions opposite to said intermediate point and radially spaced apart from said high-voltage winding;

coarse tap coil means connected to said end conductor means and disposed coextensively with said high-voltage winding;

coarse tap selector means for changing over the tap connection to said coarse tap coil means;

fine tap coil means connected to said coarse tape selector means and wound together with said end conductor means, said fine tap coil means being wound concentrically with a radially spaced from said high-voltage winding;

fine tap selector means for selecting one of taps of said fine tap coil means; and diverter switch means for making on-load tap change-over of the connection to the tap selected by said tap selector means.

2. An on-load tap-changing transformer as claimed in claim 1, wherein said end conductor means is disposed closely adjacent to one of conductors constituting said fine tap coil means, which is associated with the maximum voltage tap of said fine tap coil means.

3. An on-load tap-changing transformer as claimed in claim 1, wherein said end conductor means is wound together with said fine tap coil means so as to be concentrically wound and radially spaced apart from said high-voltage winding.

4. An on-load tap-changing transformer as claimed in claim 4, wherein said end conductor means is wound so as to occupy about 10% of the number of turns of said high-voltage winding.

* * * * *